United States Patent [19]

Booker

[11] Patent Number: 4,499,182

[45] Date of Patent: Feb. 12, 1985

[54] IN SITU FILM HARDENING WITH PYRIDINIUM CHLOROCHROMATE AND ALDEHYDE PRECURSOR ALCOHOL

[75] Inventor: Reginald A. Booker, New Castle, Del.

[73] Assignee: E. I. Du Pont de Nemours and Company, Wilmington, Del.

[21] Appl. No.: 540,774

[22] Filed: Oct. 11, 1983

[51] Int. Cl.[3] ..... G03C 1/30

[52] U.S. Cl. ..... 430/621; 260/117; 430/623

[58] Field of Search ..... 430/621, 623; 260/117

[56] References Cited

U.S. PATENT DOCUMENTS

| | | | |
|---|---|---|---|
| 3,951,940 | 4/1976 | Ballantine et al. | 430/623 |
| 4,014,862 | 3/1977 | Ballantine et al. | 260/117 |
| 4,124,397 | 11/1978 | Abele et al. | 96/109 |
| 4,175,970 | 11/1979 | LeStrange | 430/529 |
| 4,399,214 | 8/1983 | Lohmer | 430/621 |

*Primary Examiner*—Won H. Louie

[57] ABSTRACT

A process of forming a hardened photographic film by in situ generation of hardener by incorporating an aldehyde precursor alcohol in one layer and pyridinium chlorochromate in an adjacent layer. Preferred aldehyde precursor alcohol is 1,5-pentanediol or methanol.

6 Claims, No Drawings

IN SITU FILM HARDENING WITH PYRIDINIUM CHLOROCHROMATE AND ALDEHYDE PRECURSOR ALCOHOL

BACKGROUND OF THE INVENTION

1. Field of the Invention

The present invention relates to hardening gelatin layers in photographic silver halide films.

2. Description of the Prior Art

Photographic films are commonly formed by coating two or more layers on a support. The layers comprise a wide range of aqueous dispersions of both light-sensitive and auxiliary compositions. Many films comprise two layers wherein a gelatino-silver halide emulsion is coated on the support and is then overcoated with a protective or antiabrasion layer.

A wide variety of agents are known for hardening gelatin layers in photographic silver halide films, e.g., Chrome alum, formaldehyde, glutaraldehyde, glyoxal and 1,3,5-triacrylolyl-hexahydro-S-triazone. Abele et al, U.S. Pat. No. 4,124,397, describes a process in which glutaraldehyde and its derivatives are injected into a photographic emulsion to avoid adverse effects on sensitivity and premature hardening; while Le Strange, U.S. Pat. No. 4,175,970, describes sensitization of a silver halide emulsion with a combination of glutaraldehyde and an aromatic sulfonic acid.

Glutaraldeyde is known to crosslink gelatin as much as 3600 times as fast as formaldehyde. Because of this rapid hardening action glutaraldehyde serves an important role as a hardener in developers. When it is used in a developer the sensitization and premature hardening problems associated with incorporation of glutaraldehyde in a sensitive silver halide emulsion do not occur.

It would be a significant advance to be able to employ a hardener such as glutaraldehyde directly with a silver halide emulsion and obtain rapid hardening without the drawbacks of special equipment and procedures.

SUMMARY OF THE INVENTION

Hardening of a photographic film according to the present invention involves incorporation of pyridinium chlorochromate in one coating composition and an aldehyde precursor alcohol in another composition coated adjacently, followed by drying. The coated layers produce the aldehyde via component diffusion and the in situ produced aldehyde reacts with the gelatin to harden the film.

Rapid and effective hardening within a photographic film can be accomplished by incorporation of one reactant in the silver halide emulsion layer and the other in an adjacent layer.

A preferred system for the practice of the present invention contains 0.1 to 1 mole of pyridinium chlorochromate in one layer and 0.05 to 0.5 mole of 1,5-pentanediol or 1 mole methanol in another layer per 100 g of gelatin.

DETAILED DESCRIPTION OF THE INVENTION

In situ formation of glutaraldehyde can be represented by the following equations.

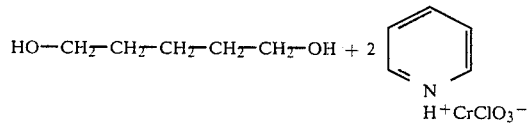

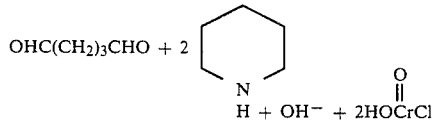

In a similar fashion other aldehyde precursor alcohols can be oxidized to aldehydes to provide in situ film hardening according to the present invention. Suitable aldehyde precursors alcohols have the formula $CH_3$—OH or HO—R—OH where R may comprise 2 to 6 carbon atoms. In particular, the aldehyde precursor may be 1,5-pentanediol, 1,4 cyclohexanedimethanol, pentaerythritol, dipentaerythritol, methanol, glycerol, ethylene glycol or 2-hydroxyethyl ether.

It should be obvious that 1 mole of an aldehyde precursor of the formula $CH_3$—X will react with 1 mole of pyridinium chlorochromate to yield the aldehyde; while 1 mole of an aldehyde precursors of the formula X—R—X will react with 2 moles of pyridinium chlorochromate to yield the aldehyde. Thus any large imbalance of additions in the two layers would serve no useful purpose because the excess could not react to produce hardener in the film.

Useful amounts of either the pyridinium chlorochromate or the aldehyde precursor alcohol may be between 0.01 and 2.0 mole per 100 g of gelatin in the layer to which they are added. Preferred amounts range from 0.05 to 1.0 mole of reactant per 100 g of gelatin in the layer in order to obtain the degree of hardening usually required by commerical films.

Compounds of the present invention can be added to a wide range of coated layers to in situ harden an aldehyde-crosslinkable protective colloid or binder. These include not only emulsion and antiabrasion layers but also underlayers, anticurl backings, release layers and mottle layers. In a three-layer coating it would be possible to put one reactant in the middle composition and distribute the other reactant in both the top and bottom layer. In a multiple-layer coating the compounds could be alternated from layer to layer to provide maximum diffusion and reaction throughout the coated film.

The following examples serve to illustrate the operation of the present invention without limiting the practice of its concept.

EXAMPLE 1

A silver iodobromide emulsion was prepared and gold- and sulfur-sensitized according to known techniques in the art. After final additions were made the emulsion was divided for coating as a control without further additions and for experimental coatings per the present invention.

A gelatin solution was prepared for overcoating the emulsion. This was also split into portions. One portion which served as a control received an addition of 0.185 mole of formaldehyde per 100 g of gelatin in the overcoat composition.

For the control film the emulsion with no addition was coated on a polyethyleneterephthalate support and overcoated with the control overcoat containing formaldehyde.

Based on 100 g of gelatin in the emulsion a first experimental emulsion contained 1 g pentaerythritol and a second experimental emulsion contained 1 g 1,4-cyclohexanedimethanol.

The experimental overcoat per 100 g of gelatin contained an addition of 3.6 pyridinium chlorochromate.

The emulsions were then overcoated to provide films demonstrating the in situ hardening according to the present invention and a control.

After drying, the films were cut into samples for sensitometric and physical tests to determine hardening.

Melting points were determined by marking film strips with a black mark made with coater permanent brand marker and placing the strips in a 10% sodium hydroxide solution and raising the solution temperature until the black mark was observed to disappear. Wet gouge susceptibilities were determined by placing an increasing weight load on a sapphire stylus point as it is drawn across a film immersed in developer or distilled water. A melting point below 35° C. and a wet gouge force of 0 indicate that the gelatin has not been hardened. The maximum reading for the wet gouge force was 124 grams.

Table 1 contains comparative data obtained after the films had aged for five days.

TABLE 1

| FILM | MELTING POINT | WET GOUGE FORCE |
|---|---|---|
| Control | 72° C. | 10.7 |
| Pentaerythritol | 54° C. | 13.3 |
| 1.4 Cyclohexanedimethanol | 68° C. | 15.5 |

These results clearly show hardening in all three films.

EXAMPLE 2

The reactions of a series of alcohols with pyridinium chlorochromate were studied in a 6% gelatin solution at 35° C. and pH 6 using viscosity measurements. Many of these showed an effect on viscosity of the aqueous gelatin in comparison to a control containing formaldehyde which effectively gelled the solution within about four and one-half hours of adding the formaldehyde. Thus, it was possible to use these results to determine which alcohols would serve to react with pyridinium chlorochromate in an adjacent film layer to give in situ hardening according to the present invention.

Table 2 contains comparative results obtained when 0.2 mol of alcohol and 0.04 mol of pyridinium chlorochromate (PCC) was added to 200 g of a six percent gelatin solution at 35° C. and pH 6. Controls containing only the alcohol showed no significant increase in the viscosity when measured up to three hours. A vacuum-jacketed viscosity pipet in the 2 to 30 centistoke range was used for determining the drain times in seconds.

With the exception of triethylene glycol there were significant viscosity increases which indicate that a hardening reaction was occurring due to the oxidation of the aldehyde precursor alcohol to an aldehyde by the pyridinium chlorochromate. As indicated in the table the hardening took place so rapidly in some instances that few or no readings could be taken because of the gelling action.

TABLE 2

| | |
|---|---|
| Test 1 | PCC + 1,5-pentanediol |
| Test 2 | PCC + 1,4-cylohexanedimethanol |
| Test 3 | PCC + pentaerythritol |
| Test 4 | PCC + dipentaerythritol |
| Test 5 | PCC + methanol |
| Test 6 | PCC + glycerol |
| Test 7 | PCC + ethylene glycol |
| Test 8 | PCC + 2-hydroxyethyl ether |
| Test 9 | PCC + triethylene glycol |
| Test 10 | Control gelatin solution only |

OBSERVATIONS AND DRAIN TIMES IN SECONDS

| TEST | INITIAL | 1.5 HR | 2.5 HR | 3.5 HR | 4.5 HR |
|---|---|---|---|---|---|
| 1 | 180 | Gelled | | | |
| 2 | | Gelled within 5 minutes | | | |
| 3 | | Gelled immediately | | | |
| 4 | | Gelled immediately | | | |
| 5 | | Gelled immediately | | | |
| 6 | 87 | Gelled | | | |
| 7 | 47 | 148 | Gelled | | |
| 8 | 37 | 52 | 68 | 80 | 105 |
| 9 | 27 | 34 | 38 | 44 | 51 |
| 10 | 41 | 48 | 47 | 48 | 49 |

I claim:

1. A process of forming a hardened photographic film in which a gelatino-silver halide emulsion is coated on a support and subsequently dried characterized in that an aldehyde hardening agent is formed in situ by reacting an aldehyde precursor alcohol and pyridinium chlorochromate, both being initially present in one or more layers of the film.

2. A process of claim 1 where the aldehyde precursor has the formula $CH_3$—OH or HO—R—OH and R may be 2 to 6 carbom atoms.

3. The process of claim 1 where the aldehyde precursor is selected from 1,5-pentanediol, 1,4-cychohexane dimethanol, pentaerythritol, dipentaerythritol, methanol, glycerol, ethylene glycol, and 2-hydroxyethyl ether.

4. A process of forming a hardened photographic film in which a layer comprised of silver halide dispersed in an aldehyde-crosslinkable protective colloid is coated on a support in contact with another layer and dried to form the film, characterized in that an aldehyde hardening agent is formed in situ by reacting an aldehyde precursor alcohol, initially present in one layer of the film, and pyridinium chlorochromate, initially present in an adjacent layer of the film.

5. The process of claim 4 wherein each of said layers contains 0.1 to 1.0 mole, per 100 g of gelatin, of aldehyde precursor alcohol and pyridinium chlorochromate.

6. The process of claim 4 wherein the aldehyde precursor alcohol is incorporated into the silver halide layer and the pyridinium chlorochromate is incorporated into an overcoat layer.

* * * * *